US012313053B2

(12) United States Patent
Reich et al.

(10) Patent No.: US 12,313,053 B2
(45) Date of Patent: May 27, 2025

(54) ALTERNATIVE COMPRESSOR HEAD ARRANGEMENT

(71) Applicant: NIDEC GLOBAL APPLIANCE BRASIL LTDA., Joinville (BR)

(72) Inventors: Robert Reich, Joinville (BR); Tadeu Tonheiro Rodrigues, Joinville (BR); Daniel Lacerda De Andrade, Joinville (BR)

(73) Assignee: NIDEC GLOBAL APPLIANCE BRASIL LTDA., Joinville (BR)

( * ) Notice: Subject to any disclaimer, the term of this patent is extended or adjusted under 35 U.S.C. 154(b) by 0 days.

(21) Appl. No.: 17/797,078

(22) PCT Filed: Feb. 5, 2021

(86) PCT No.: PCT/BR2021/050057

§ 371 (c)(1),
(2) Date: Aug. 2, 2022

(87) PCT Pub. No.: WO2021/159194

PCT Pub. Date: Aug. 19, 2021

(65) Prior Publication Data

US 2023/0057129 A1 Feb. 23, 2023

(30) Foreign Application Priority Data

Feb. 14, 2020 (BR) ..... 10 2020 003110 4
Jan. 15, 2021 (BR) ..... 10 2021 000805 9

(51) Int. Cl.
*F04B 39/10* (2006.01)
*F04B 39/12* (2006.01)

(52) U.S. Cl.
CPC ..... *F04B 39/1066* (2013.01); *F04B 39/1073* (2013.01); *F04B 39/125* (2013.01)

(58) Field of Classification Search
CPC . F04B 39/1066; F04B 39/1073; F04B 39/125
See application file for complete search history.

(56) References Cited

U.S. PATENT DOCUMENTS 2,118,356 A 5/1938 Money
6,929,456 B2 * 8/2005 Seo ..... F04B 39/1073 417/569

(Continued)

OTHER PUBLICATIONS

International Search Report and Written Opinion dated May 31, 2021 issued in International Application No. PCT/BR2021/050057, 9 pages.

*Primary Examiner* — Charles G Freay
(74) *Attorney, Agent, or Firm* — FOLEY & LARDNER LLP

(57) ABSTRACT

An alternative compressor head arrangement including a valve plate is provided with at least one operating hole. The alternative compressor head arrangement further includes a discharge valve blade provided with at least one operation valve and at least one mounting hole. The alternative compressor head arrangement further includes a stop blade provided with at least one valve stop and at least one mounting hole. The alternative compressor head arrangement further includes a cylinder cap provided with a flange capable of receiving at least one assembly component. The alternative compressor head arrangement further includes a suction valve blade provided with at least one operation valve and at least one mounting. The alternative compressor head arrangement further includes an interface blade provided with at least one mounting hole.

3 Claims, 10 Drawing Sheets

(56) References Cited

U.S. PATENT DOCUMENTS

| | | | | |
|---|---|---|---|---|
| 10,174,756 | B2 | 1/2019 | Rodrigues et al. | |
| 2003/0075224 | A1* | 4/2003 | Park | F16K 15/162 137/856 |
| 2004/0013552 | A1* | 1/2004 | Kim | F04B 39/1073 417/569 |
| 2005/0056329 | A1 | 3/2005 | Lee et al. | |
| 2009/0301449 | A1 | 12/2009 | Ogawa et al. | |
| 2011/0070101 | A1* | 3/2011 | Mezza | F04B 39/06 417/452 |
| 2013/0108493 | A1* | 5/2013 | Wan | F04B 39/06 417/559 |

* cited by examiner

--Prior Art--

--Prior Art--

--Prior Art--

ALTERNATIVE COMPRESSOR HEAD ARRANGEMENT

CROSS REFERENCE TO RELATED APPLICATIONS

This application is a national stage entry of PCT Application No. PCT/BR2021/050057, filed on Feb. 5, 2021, which claims priority to Brazilian Application No. 10 2020 003110 4, filed on Feb. 14, 2020, and Brazilian Application No. 10 2021 000805 9, filed on Jan. 15, 2021, the contents of all of which are incorporated herein by reference in their entireties.

TECHNICAL FIELD

The invention in question refers to an alternative compressor head arrangement and, more particularly, a head arrangement integrated by at least one valve plate, at least one suction valve, at least one discharge valve, at least one support and/or fixing means and at least one flexible interface between that discharge valve and said support and/or fixing means. According to the invention in question, such an alternative compressor head arrangement is able to avoid wear that is normally observed in the flexible region of the discharge valve.

The invention in question is especially intended for an alternative compressor head arrangement whose discharge valve comprises a vane-type valve used next to a valve plate discharge hole of an airtight reciprocating compressor applied in refrigeration systems.

BACKGROUND OF THE INVENTION

In steam compression cooling systems, compressors play two key roles: pumping coolant through the cooling system and simultaneously raising fluid pressure in the compressor passage between low- and high-pressure lines. The most common types of compressors isolate parts of the working fluid in a variable volume chamber, the reduction of volume to the same mass percentage results in pressure elevation, this is the compression process. The alternative compressor, as shown in FIG. 1 of this application, is one of the most widespread concepts, the variable volume chamber is constructed using a piston and cylinder arrangement, the piston alternates its position between downward motion that increases the volume of the chamber and the upward movement that reduces the volume of the chamber, origin of the term alternative compressor.

Automatic vane valves are employed to control suction and discharge flows, which are commonly constructed of thin steel plates, and function as embedded beams, the movable end is mounted on a gas flow passage hole. These dispense actuator devices, responding to variations in gas pressure and flow.

At least one hole and valve assembly is required for the suction process and another for the discharge process. The first step of the compression cycle is called suction and occurs with the downward movement of the piston reducing the pressure of the cylinder chamber, which, when reaching a pressure lower than the low line pressure generates a positive pressure differential on the valve, which opens and allows gas to enter the cylinder chamber, the gas flow is also responsible for sustaining the valve opening, this step remains until the piston reaches the maximum displacement position also known as the lower neutral, at this time the flow ceases and the valve returns to its resting position. The second step proceeds with the upward movement of the piston, where the compression itself occurs, in this step both the suction and discharge valves are in their resting position, isolating the chamber from the cylinder. The compression process ends the moment the cylinder pressure reaches the high line pressure, then a positive pressure differential occurs on the discharge valve that opens allowing the gas flow, then deflating the discharge process, which ends when the piston reaches the apex of the upward movement also known as the upper neutral, where the flow of gas that sustains the valve ceases and the valve returns to its resting position. This is the end of the complete process of a compressor cycle, a new one then begins with the downward movement.

The gas passage holes are constructed of rigid plates called the valve plate, which on are mounted the suction and discharge valves. On the discharge valve is mounted an opening limiter, called a valve stop. On the valve and discharge and stop is mounted a chamber to receive the discharged gas at high pressure called cylinder cover. The set of the above-mentioned components is called head, which are usually mounted in stacked configuration on the piston cylinder arrangement. Additionally, sealing elements called joints or gaskets are used, which are positioned on the interfaces of the cylinder cap with the valve plate.

The compressor is subjected to long periods of operation and with a wide range of operating conditions, resulting in repetitive and prolonged efforts on the valves, which has dynamic operation. Therefore, such components have specific reliability requirements, including wear resistance. The stacked arrangement of components associated with a cyclic movement of opening and closing generates friction located in the choking region of the valve, which wears out the material that associated with flex fatigue results in rupture. Once the valve is broken, it no longer seals the gas passage hole, and therefore makes it impossible to isolate gas canisters inside the cylinder chamber and finally the compression process. Valve rupture represents a complete failure of compressor function. The valves are then developed to eliminate the wear process and ensure the compressor life cycle.

The current state of the art is integrated by the arrangement of reciprocating compressor valves presented in the North American patent U.S. Ser. No. 10/174,756. Such an arrangement comprises at least one discharge valve, at least one auxiliary discharge valve and at least one valve stop, and the discharge valve comprises at least one clamping end, at least one handling end and at least one bending area, where the valve stop comprises at least one support area bounded by at least one end. According to the technical proposal of said U.S. patent U.S. Ser. No. 10/174,756, the bending area of the main valve and the end of the valve stop support area are longitudinally misaligned, and the dimension related to the extent defined between the beginning of the fixation base and the beginning of the main valve flexion area is greater than the dimension related to the extent defined between the beginning of the support area and the end of the valve stop. Also, according to the technical proposal of said U.S. patent U.S. Ser. No. 10/174,756, the auxiliary valve is arranged between the main valve and the valve stop, so as to act as an additional rigidity said main valve during the process of opening and closing the valve, in which this same auxiliary valve provides a rigid interface in the fixing region enters the discharge valve and said valve stop. Thus, it is observed that, although the fixing end of the main valve, the fixation end of the auxiliary valve and the support area of the valve stop are juxtaposed, the flexion area of the main valve and the flexion area of the auxiliary valve are longitudinally misaligned.

The arrangement of reciprocating compressor valves presented in the U.S. patent U.S. Ser. No. 10/174,756 is illustrated in FIGS. 2 and 3 of the present invention.

Although said arrangement of reciprocating compressor valves presented in the U.S. patent U.S. Ser. No. 10/174,756 achieves all the proposed objectives, it was found that the main valve, once set on the upper surface by the valve stop or auxiliary valve, tends to suffer friction in its bending area. This friction occurs because the choking interface of the main valve, either with the valve stop or the auxiliary valve, is especially harmful in long-life cycles during high frequency compressor operation, as these cycles subject the main valve to repeated friction that accelerates wear in its bending area.

Additionally, the occurrence of wear in the bending area of the main valve of the alternative compressor valve arrangement presented in the U.S. patent U.S. Ser. No. 10/174,756 is also associated with variability of the clamping force in the choking region, as the application of a reduced or excessive force in the choking region of the main valve results in a high coefficient of friction between the components as well as local increase in stress due to the combined stresses of fixing and bending of the main valve. Consequently, in order for the service life of the reciprocating compressor valve arrangement presented in US patent U.S. Ser. No. 10/174,756 to be extended, it is necessary that the force in the choking region of the main valve has an adequate range with low variability. It occurs, however, that the dimensioning of this force in the process of choking is subject to variations of machinery, and, therefore, is subject to the occurrence of application of highly variable force.

Although the arrangement of reciprocating compressor valves presented in the U.S. patent U.S. Ser. No. 10/174,756 comprises modular components and not associated with the means of fastening the head, it is verified that the same aspects that can be improved identified also apply to the embodiments that use integral components, which are directly associated with the means of fastening the head This means that the same improvementable aspects identified in the arrangement of reciprocating compressor valves presented in the U.S. patent U.S. Ser. No. 10/174,756 are also observed in the alternative compressor valve arrangement presented in the U.S. patent U.S. Pat. No. 6,929,456, which comprises components (main valve and valve stop) directly associated with the alternative compressor head fixation means. For quick reference, the arrangement of reciprocating compressor valves presented in the U.S. patent U.S. Pat. No. 6,929,456 is illustrated in FIG. 4 of the present document.

Invention Objectives

In this sense, in view of the problems arising from rigid interfaces in the interfaces between main valves and their means of fixation (auxiliary valve, valve stop or others), as observed in the arrangements of alternative compressor valves presented in the state of the art, the invention in question arises with the main objective of revealing an alternative compressor head arrangement capable of eliminating the occurrence of friction wear in the bending area of the discharge valve.

In addition, it is an additional goal of the invention to present an alternative compressor head arrangement whose general fixation between the components is simplified and occurs through the same component alignment reference system.

Nevertheless, two alternative embodiments are presented, with the objective of also eliminating the occurrence of wear on the main and auxiliary valves, when the auxiliary valve is used.

Invention Summary

The alternative compressor head arrangement of the present invention comprises at least one valve plate provided with at least one operating hole, at least one discharge valve blade provided with at least one operation valve, at least one mounting hole, at least one stop blade provided with at least one valve stop and at least one mounting hole, at least one cylinder cover provided with at least one flange capable of receiving at least one mounting component, and at least one suction valve blade provided with at least one operation valve and at least one mounting hole.

Furthermore, said operation valve comprises a static end, a dynamic end and a bending area arranged between said static end and said dynamic end.

According to a preferred embodiment, at least one interface blade with at least one mounting hole is additionally provided.

Said interface blade, made of flexible material, shall be arranged between said discharge valve blade and said stop blade. Said interface blade comprises at least one mass part coincident with the static end of the discharge valve blade operation valve and at least one hollow part coincident with the dynamic end and the bending area of the discharge valve blade operation valve.

The mounting holes of the valve blade, the interface blade and the stop blade are subject to mutual alignment by means of at least one mounting component.

Furthermore, the interface between the static end of the operation valve of the discharge valve blade and the stop valve of the stop blade is fully performed by the interface blade, and more particularly the interface between the static end of the discharge valve operation valve and the stop blade valve stop is fully realized by the massive part of the interface blade. In addition, it is also verified that the bending area of the operation valve of the discharge valve blade is free of contact in relation to the stop blade.

According to an alternative embodiment, the alternative compressor head arrangement comprises, in addition to the components present in the preferred embodiment, at least one auxiliary valve blade provided with at least one auxiliary operation valve and at least one mounting hole, wherein the auxiliary operation valve comprises a static end, a dynamic end and a bending area arranged between said static end and said dynamic end.

In this alternative embodiment it is also provided at least one interface blade provided with at least one mounting hole. Said interface blade, made of flexible material, is arranged between said discharge valve blade and said auxiliary valve blade. Moreover, it is also verified that said interface blade comprises at least one massive part coincident with the static end of the auxiliary valve blade operating auxiliary valve assist valve and at least one hollow part coincident with the dynamic end and the bending area of the auxiliary valve operation valve, and the assembly holes of the discharge valve blade, the interface blade, stop blade and auxiliary valve blade are subject to mutual alignment by means of at least one assembly component.

Furthermore, it is also noted that the interface between the static end of the discharge valve blade operation valve and the static end of the auxiliary valve operation auxiliary valve is fully performed by the interface blade, and more particularly the interface between the static end of the discharge valve blade operation valve and the static end of the auxiliary valve blade of the auxiliary operation valve is fully performed by the massive part of the interface blade. Additionally, it is also verified that the bending area of the operation valve of the discharge valve blade is free of contact in relation to the auxiliary valve blade.

According to a second alternative embodiment of the invention in question, the alternative compressor head arrangement comprises, in addition to the components present in the first alternative embodiment, at least one interface blade provided with at least one mounting hole and at least one additional interface blade provided for by at least one mounting hole, and that interface blade is arranged between said discharge valve blade and said auxiliary valve blade and said additional interface blade is arranged between said auxiliary valve blade and said stop blade.

In this alternative embodiment it is possible to note that said interface blade and said additional interface blade are both made of flexible material, wherein said interface blade comprises at least one massive part coincident with the static end of the discharge valve blade operation valve and at least one hollow part coincident with the dynamic end and the bending area of the discharge valve blade operation valve. Said additional interface blade, in turn, comprises at least one massive part coincident with the static end of the operation auxiliary valve of the auxiliary valve blade and at least a hollowed part coincident with the dynamic end and the bending area of the operation auxiliary valve of the auxiliary valve blade. Furthermore, the mounting holes of the discharge valve blade, the interface blade, the additional interface blade, the stop blade and the auxiliary valve blade are subject to mutual alignment by means of at least one mounting component.

According to this alternative embodiment, it is verified that the interface between the static end of the operation valve of the discharge valve blade and the static end of the auxiliary valve of the auxiliary valve blade is fully performed by the interface blade, and, more particularly, the interface between the static end of the discharge valve blade operation valve valve fully performed by the massive part of the interface blade. In addition, it is also verified that the bending area of the operation valve of the discharge valve blade is free of contact in relation to the auxiliary valve blade.

Also, according to this alternative embodiment, it is verified that the interface between the static end of the auxiliary operation valve and the valve stop of the stop blade is fully realized by the additional interface blade, and, more particularly, the interface between the static end of the auxiliary operation valve and the valve stop of the stop blade is fully realized by the massive part of the additional interface blade. In addition, the bending area of the auxiliary valve operation of the auxiliary valve blade is free of contact in relation to the stop blade.

BRIEF DESCRIPTION OF THE DRAWINGS

The objectives and advantages of the present invention will become clearer through the following detailed description of the example and non-limiting drawings presented at the end of this document.

DETAILED DESCRIPTION OF THE INVENTION

Figure 1:
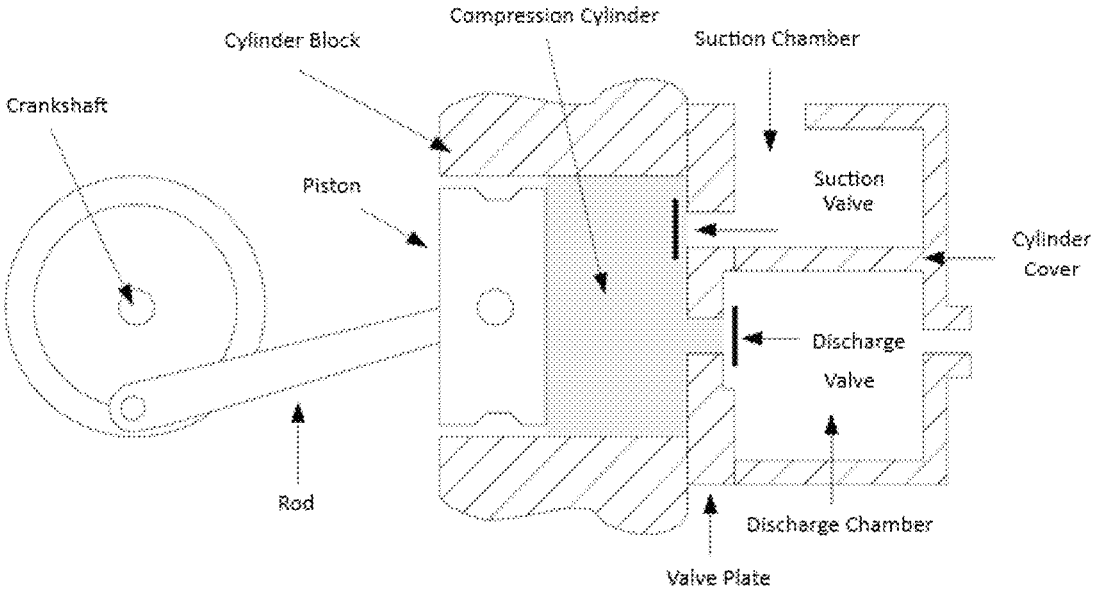
FIG. 1 is a schematic representation of an alternative compressor and its main components.
Figure 2:
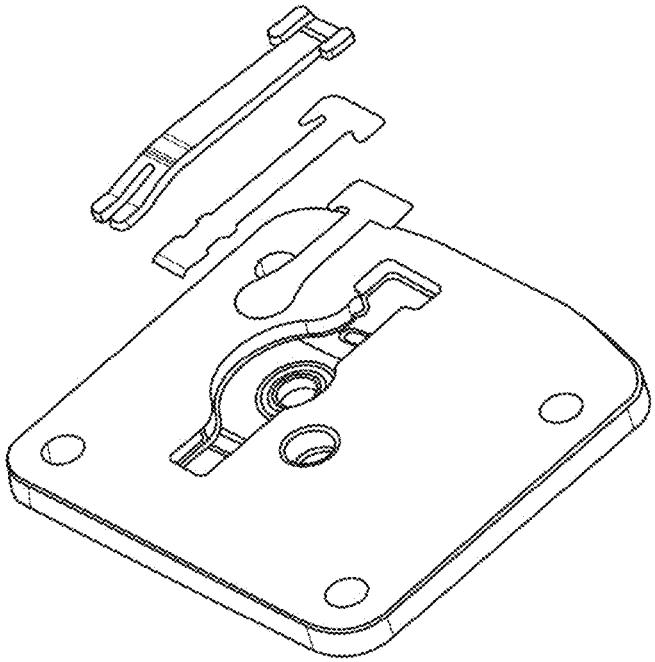
FIGS. 2, 3 and 4 comprise slightly edited reproductions (removal of original numerical references) of figures contained in the U.S. patents U.S. Ser. No. 10/174,756 and U.S. Pat. No. 6,929,456. More particularly, FIGS. 2 and 3 refer to figures of the U.S. patent U.S. Ser. No. 10/174,756 and FIG. 4 refers to a figure of the U.S. patent U.S. Pat. No. 6,929,456.
Figure 3:
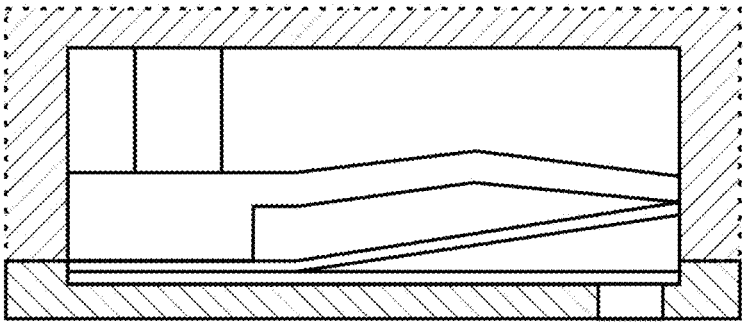
Figure 4:
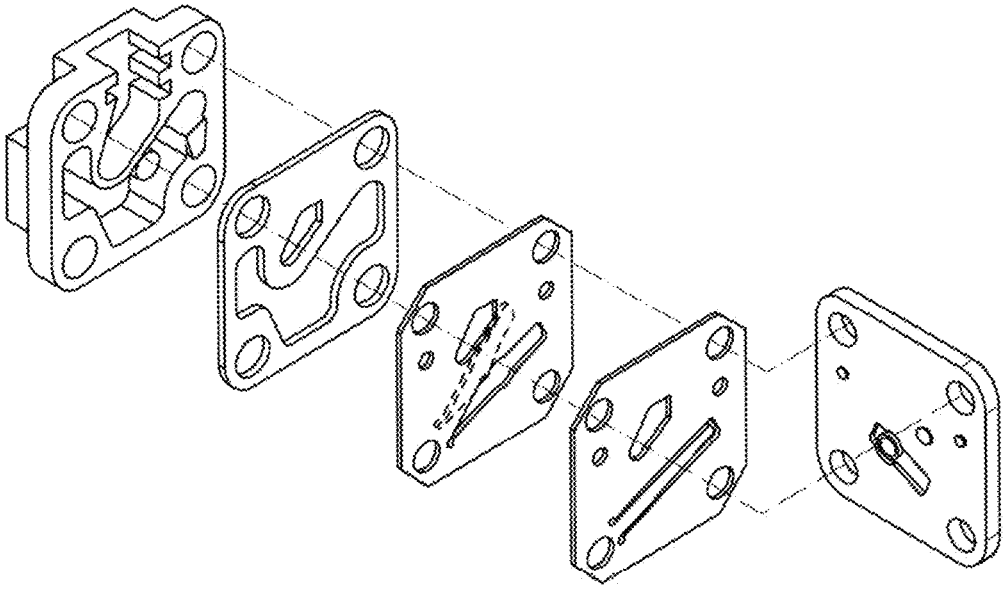
Figure 5:
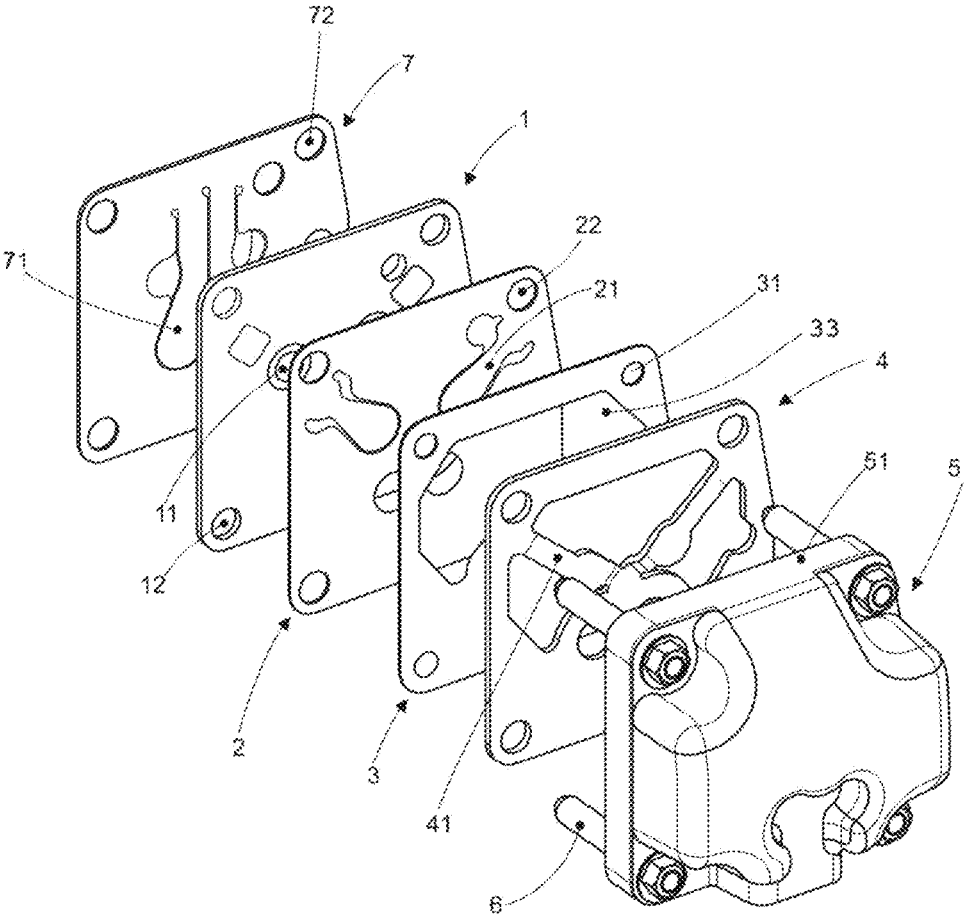
FIG. 5 illustrates, in an exploded perspective, the preferential embodiment of the alternative compressor head arrangement according to the invention in question.
Figure 6:
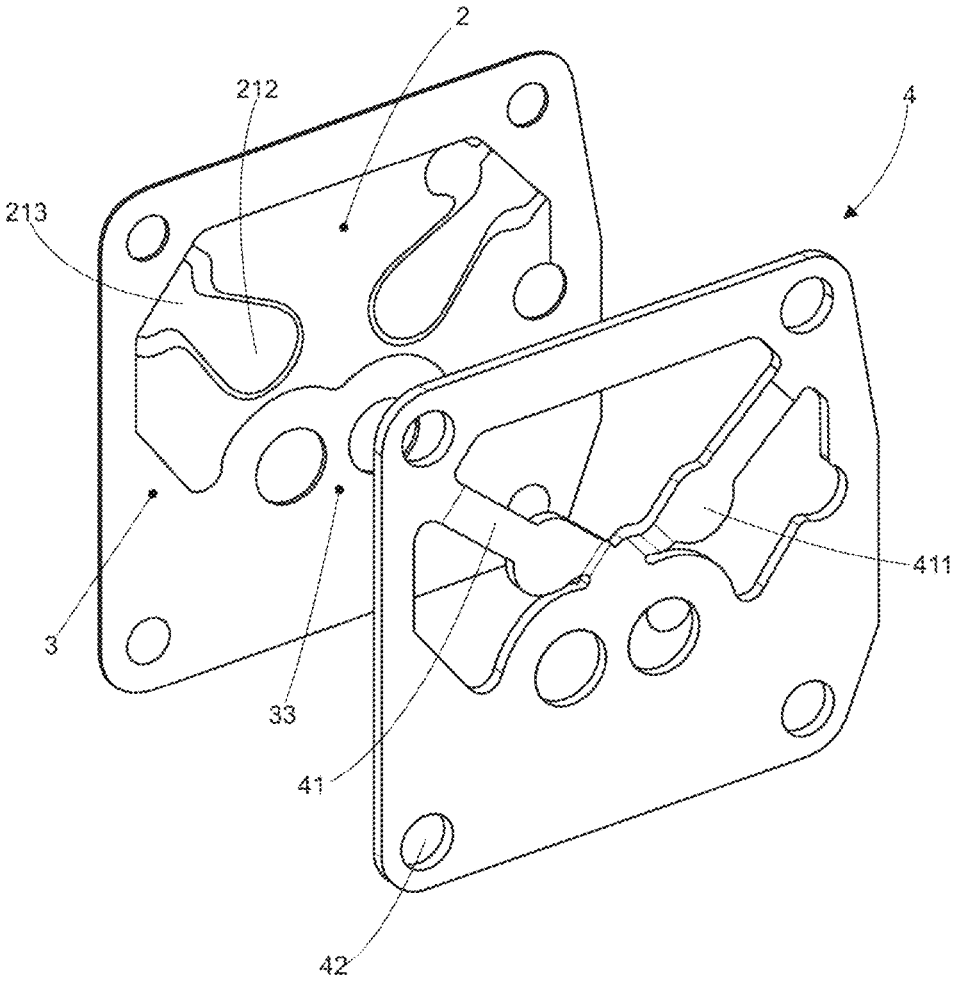
FIG. 6 illustrates, in an enlarged exploded perspective, constructive details of the operation valve, the interface element and the valve stop that integrate the preferential embodiment of the alternative compressor head arrangement according to the invention in question.
Figure 7:
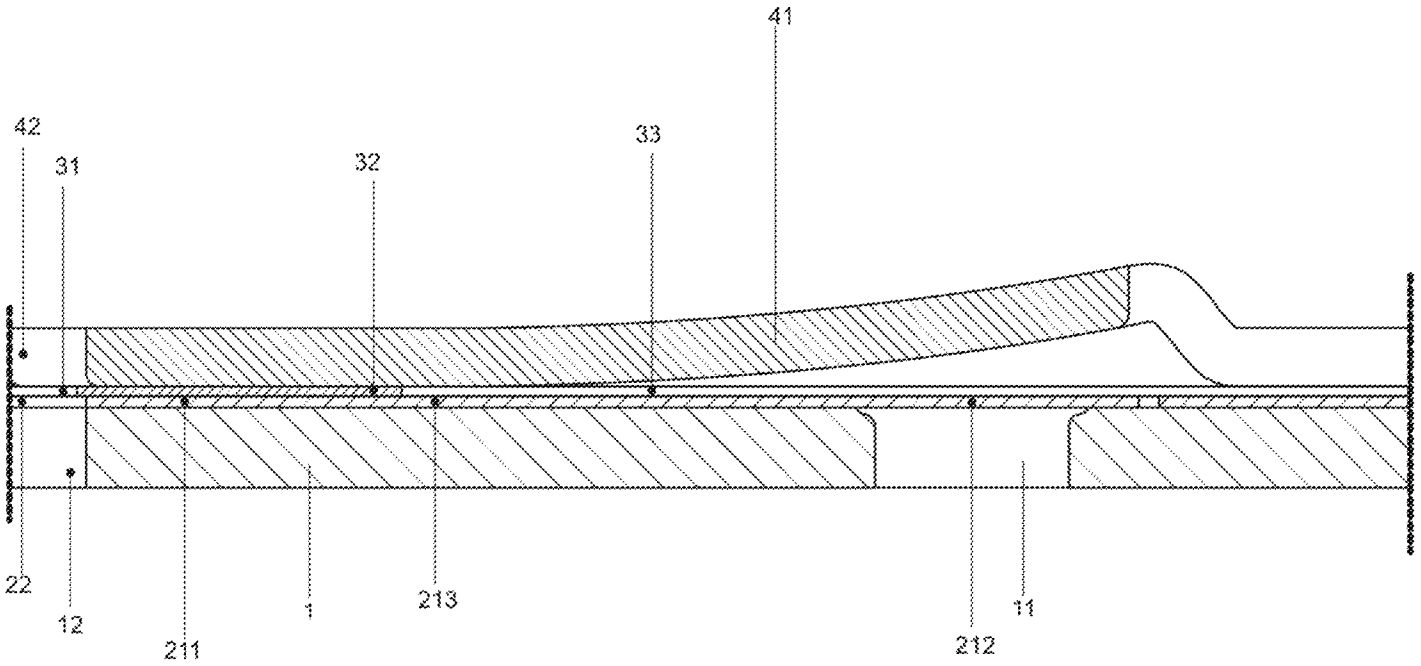
FIG. 7 illustrates, in a schematic side cut, the assembly of part of the components that integrate the preferential embodiment of the alternative compressor head arrangement according to the invention in question.

In view of the objectives of the invention in question, an alternative compressor head arrangement is revealed, the preferred embodiment of which is illustrated in FIGS. 5, 6 and 7.

According to this preferred embodiment, the alternative compressor head arrangement consists of a valve plate 1, a discharge valve blade 2, an interface blade 3, a stop blade 4, a cylinder cap 5, assembly components 6 and a suction valve blade 7.

Preferably, the alternative compressor head arrangement revealed here may also include at least one seal joint.

In this way, valve plate 1 comprises a rigid, rigid plate of quadrangular shape used to close the free end of the compression cylinder (not illustrated) of the reciprocating compressor (not illustrated). Furthermore, said valve plate 1 comprises four operating holes 11 (two discharge and two suction) arranged inside its area, and comprises four mounting holes 12, each arranged at one of its ends.

Additionally, the discharge valve blade 2 has a small thickness metal blade, of quadrangular shape, comprising two operation valves 21 and four mounting holes 22. As in traditional valve blades, each of the operation valves 21 comprises a static end 211, a dynamic end 212 and a 213 bending area arranged between said static end 211 and said dynamic end 212. In addition, as with traditional valve blades, the mounting holes 22 are arranged at the ends of the general area of said discharge valve blade 2.

Also in this same direction, the stop blade 4 comprises a metal blade, of quadrangular shape, of intermediate thickness, usually between 1 mm and 3 mm, between the thickness of the valve plate 1, between 1.9 mm and 4 mm and the thickness of the discharge valve blade 2 between 0.077 mm and 0.503 mm. Two valve stops 41 and four mounting holes 42 are provided. In addition, it is worth noting that most of the area of said stop blade 4 is leaked. In any case, according to the preferred embodiment of the invention in question, each of the valve stops 41 comprises an end-of-stroke rib 411. In addition, as with traditional stop blades, the 42 mounting holes are arranged at the ends of the general area of said stop blade 4.

Also in this same sense, the cylinder cover 5 comprises a metal monoblock with internal volumes (not illustrated) and a flange 51 to receive the assembly components 6, which can comprise screws or equivalent elements.

In addition, in this same direction, the suction valve blade 7 comprises a metal blade of similar thickness to the discharge valve, of quadrangular shape, comprising two operation valves 71 and four mounting holes 72. As with traditional valve blades, each of the 71 operation valves comprises a static end, a dynamic end and a bending area arranged between said static end and said dynamic end. In addition, as with traditional valve blades, the mounting holes 72 are arranged at the ends of the general area of said suction valve blade 7.

The core of the present invention lies in the use of the interface blade 3 and its interaction with discharge valve blade 2 and with the stop blade 4 in order to avoid friction wear in the bending areas 213 of the operation valves 21.

Said interface blade 3 comprises a small thickness blade, made of flexible material, such as a compound composed of synthetic fibers, elastomers (hydraulic cardboard), cellulose, polymeric compound (engineering plastic) and metals such as copper and aluminum. In this sense, said interface blade 3 must be made of material more ductile or "softer" than the making material of the discharge valve blade 2 and the stop blade 4.

As illustrated in FIGS. 5, 6 and 7, the interface blade 3 has a quadrangular shape and is provided with four mounting holes 31 arranged at the ends of its general area.

Said interface blade 3 also comprises, in addition to a perimeter contour equivalent to the contour of a seal joint, two massive parts 32 coincident with the static ends 211 of the operation valves 21 of valve blade 2 and a large hollow part 33 coincident with the dynamic ends 212 and with the bending areas 213 of the operation valves 21 of the valve blade 2.

Whereas, as illustrated in FIG. 7, that interface blade 3 is arranged between said valve blade 2 and said stop blade 4. In this sense, the interfaces between the static ends 211 of the valves operation 21 of valve blade 2 and valve stops 41 of the stop blade 4 are fully carried out by the interface blade 3. More particularly, it is noted that the interfaces between the static ends 211 of the valve blade 21 operation valves and the valve stop 41 of the stop blade 4 are fully realized by the massive parts 32 of the interface blade 3.

Consequently, there is no physical contact between the static ends 211 and the bending areas 213 of the operation valves 21 of the discharge valve blade 2 with the stop blade 4.

Moreover, also considering that said interface blade 3 is arranged between said discharge valve blade 2 and said stop blade 4, it is observed that the bending areas 213 of the operation valves 21 of the valve blade 2 are also free of contact with stop blade 4.

In relation to the assembly and fixation of the components described herein, as illustrated in FIG. 5, the mounting holes of the discharge valve blade 2, the interface blade 3 and the stop blade 4 are subject to mutual alignment by means of the assembly components 6.

The use of a flexible interface blade 3, between two rigid blades, reduces friction in the bending areas of the operation valves, because the massive parts of the interface blade tend to deform to accompany the movements of said bending areas of the operation valves, preventing them from establishing direct physical contact with the stop blade, consequently reducing the tension of the discharge valve in the bending region defined by the massive region of the interface blade.

Figure 8:
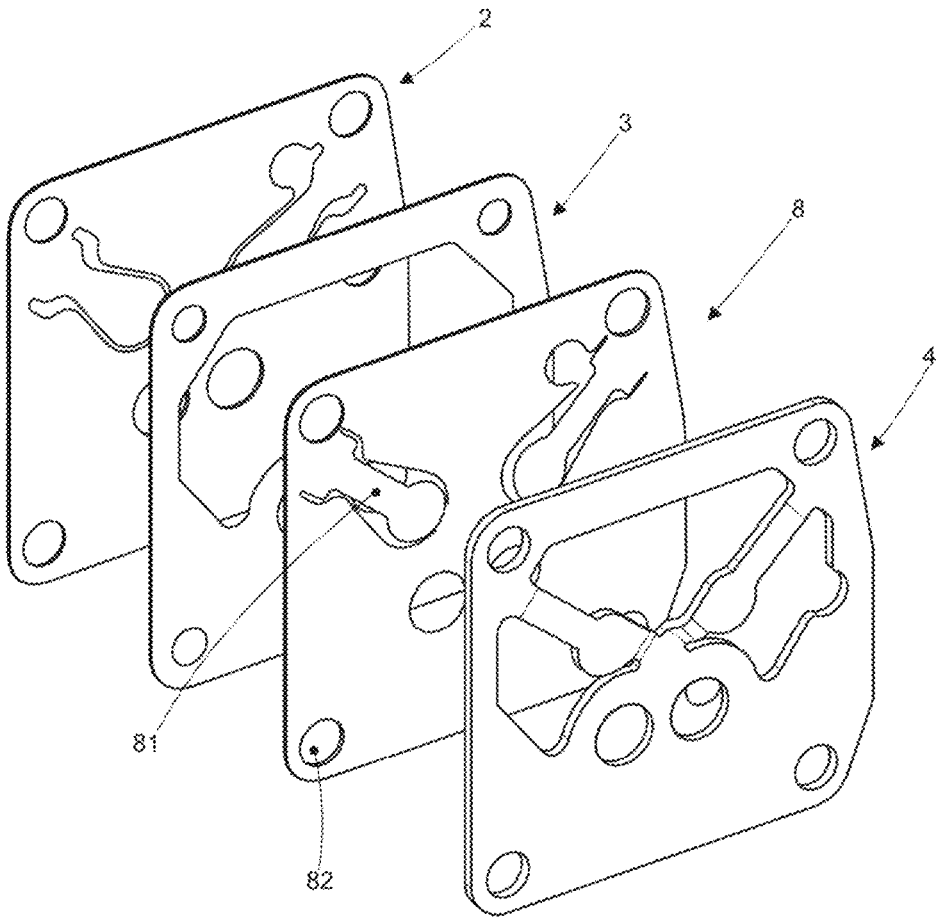
FIG. 8 illustrates, in an enlarged exploded perspective, constructive details of the operation valve, the interface element and the valve stop that integrate an alternative first embodiment of the alternative compressor head arrangement according to the invention in question.
Figure 9:
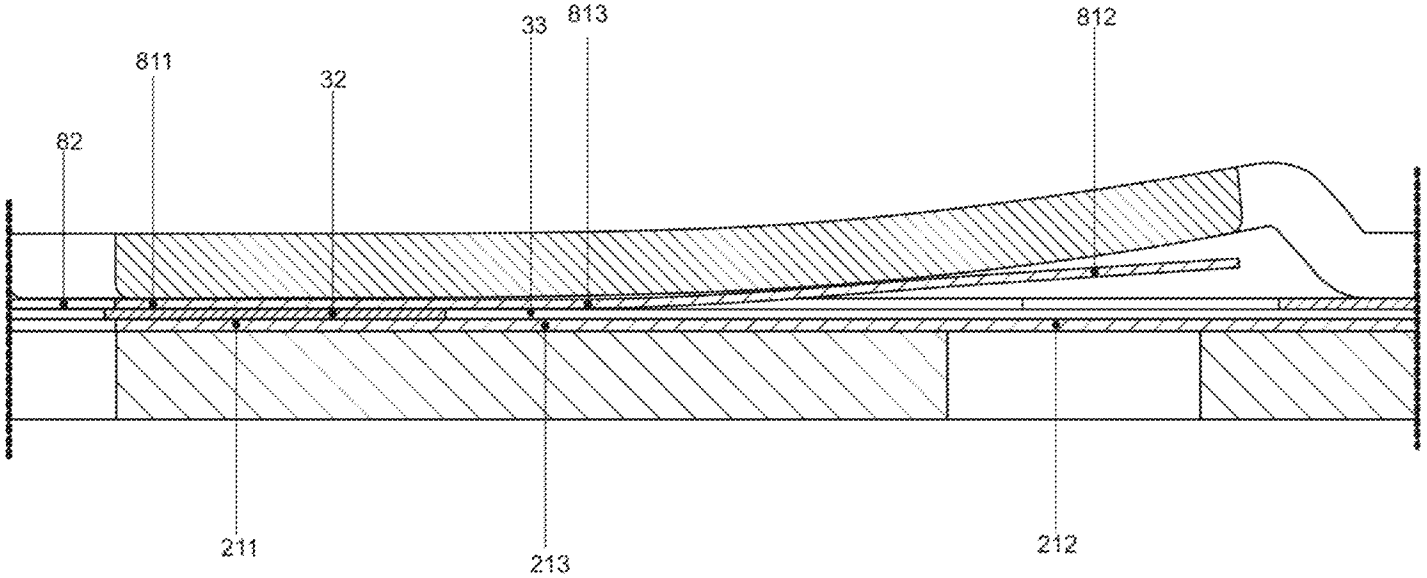
FIG. 9 illustrates, in a schematic side cut, the assembly of part of the components that integrate the first alternative embodiment of the alternative compressor head arrangement according to the invention in question.

FIGS. 8 and 9 illustrate the first alternative embodiment of the invention in question. In this embodiment, in addition to all trivial components (valve plate, cylinder cover, assembly components and suction valve blade) and all essential components (discharge valve blade 2, interface blade 3 and stop blade 4) previously described in the preferred embodiment of the invention in question, is also provided for an auxiliary valve blade 8, comprising a metal blade of small thickness, of quadrangular shape, integrated by two auxiliary valves of operation 81 and four mounting holes 82.

Considering that auxiliary operation valves 81 of auxiliary valve blade 8 are fundamentally equivalent to operation valves 21 of discharge valve blade 2, each of the aforementioned auxiliary operation valves 81 of auxiliary valve blade 8 also comprises a static end 811, a dynamic end 812 and a bending area 813 arranged between said static end 811 and said dynamic end 812.

In this sense, the auxiliary operation valves are arranged and designed in such a way as to cushion the movement of the operation valves 21 of the discharge valve blade 2.

Unlike what is observed in the preferential embodiment of the invention in question, in which the interface blade 3 is arranged between said discharge valve blade 2 and the stop blade 4, the first alternative embodiment stands out for the fact that the interface blade 3 is arranged between said discharge valve blade 2 and auxiliary valve blade 8. In this case, the stop blade 4 is arranged on the auxiliary valve blade 8.

After the introduction of the auxiliary valve blade 8 (between the interface blade 3 and the stop blade 4), the details referring to the assembly and fixation of the components described here are analogous to the assembly and fixation details observed in the preferential embodiment of the invention in question.

The main objective of this first alternative embodiment is to reduce friction in the bending areas of the operation valves of the discharge valve blade resulting from the use of auxiliary operation valves cooperating with operation valves for controlled damping of the movement of the operation valves.

Figure 10:
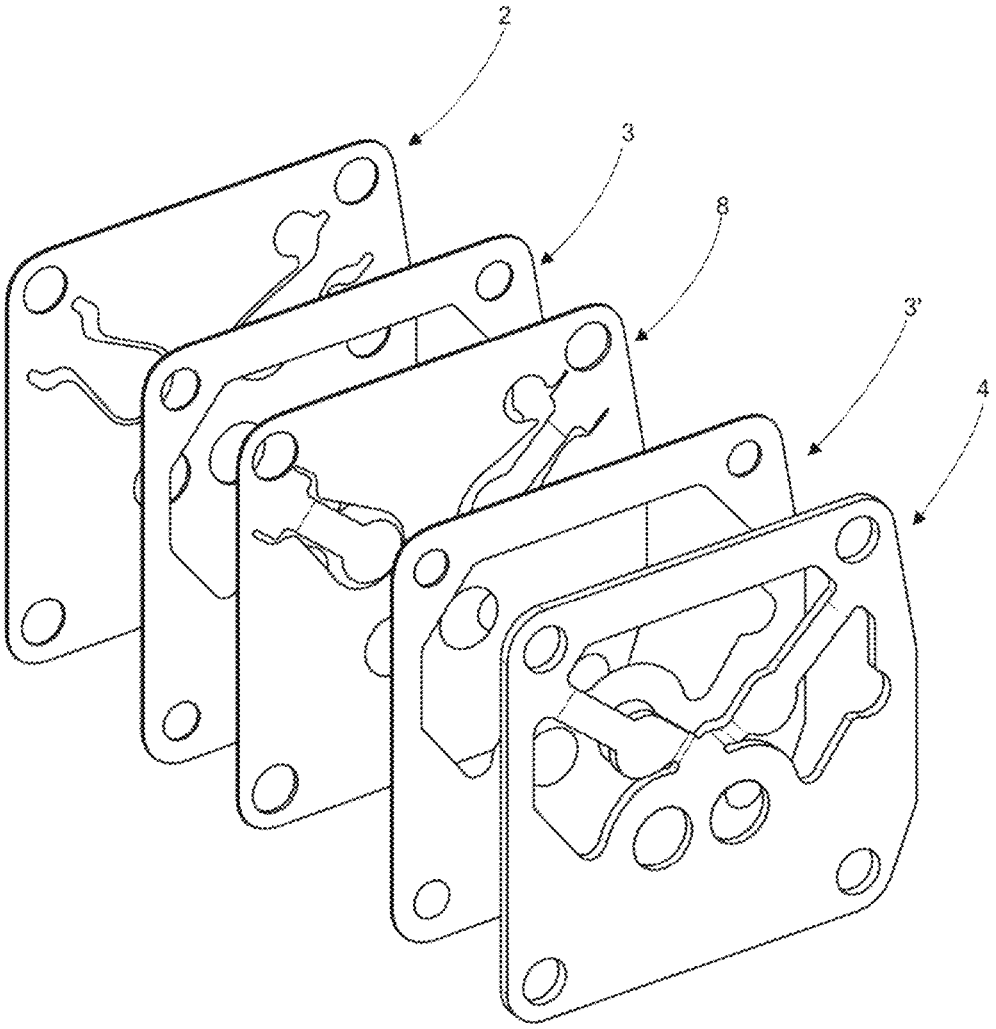
FIG. 10 illustrates, in an enlarged exploded perspective, constructive details of the operation valve, the interface element and the valve stop that integrate a second alternative embodiment of the alternative compressor head arrangement according to the invention in question.
Figure 11:
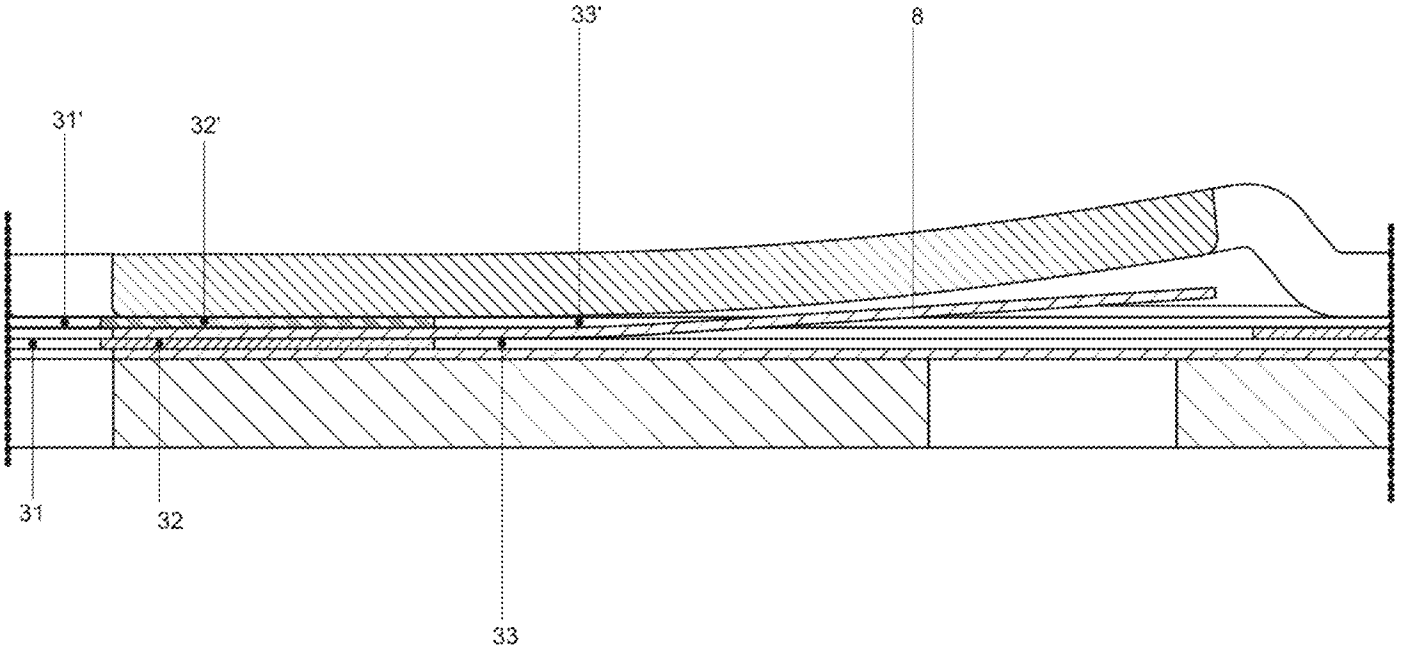
FIG. 11 illustrates, in a schematic side cut, the assembly of part of the components that integrate the second alternative embodiment of the alternative compressor head arrangement according to the invention in question.

FIGS. 10 and 11 illustrate the second alternative embodiment of the invention in question. In this realization, in addition to all trivial components (valve plate, cylinder cover, assembly components and suction valve blade) and all the essential components previously mentioned and described (discharge valve blade 2, interface blade 3, stop blade 4 and auxiliary valve blade 8) in the first alternative embodiment of the invention in question, an additional interface blade 3' is also provided, which is arranged between said auxiliary valve blade 8 and said stop blade 4.

Thus, it is noted that the aforementioned additional interface blade 3' is analogous to the interface blade 3 and, therefore, it has a quadrangular shape, besides being provided with four mounting holes 31' arranged at the ends of its general area, two massive parts 32', now coincident with the fixed ends of the auxiliary valves operation 81 of the auxiliary valve blade 8, and a large hollow part 33', now coincident with the dynamic ends and the bending areas of the auxiliary operation valves 81 of the auxiliary valve 8.

Furthermore, in this embodiment, the interface blade 3, arranged between the discharge valve blade 2 and the auxiliary valve blade 8, is responsible for reducing friction in the bending areas of the operation valves of the discharge valve blade. The additional interface blade 3', in turn arranged between the auxiliary valve blade 8 and the stop blade 4, is responsible for reducing the eventual friction in the bending areas of the auxiliary valves of operation of the auxiliary valve blade 8.

Although the present invention has been described in connection with certain preferential embodiments, it should be understood that it is not intended to limit disclosure to such particular embodiments. Instead, it is intended to cover all possible alternatives, modifications and equivalents within the spirit and scope of the invention, as defined by the attached claims.

The invention claimed is:

1. An alternative compressor head arrangement, comprising:

a valve plate (1) provided with at least one operating hole (11);

a discharge valve blade (2) provided with at least one operation valve (21) and at least one mounting hole (22); each said at least one operation valve (21) comprising a static end (211), a dynamic end (212) and a bending area (213) arranged between said static end (211) and said dynamic end (212);

a stop blade (4) provided with at least one valve stop (41) and at least one mounting hole (42); each said at least one valve stop (41) comprising an end-of-stroke rib (411);

a cylinder cap (5) provided with a flange (51) capable of receiving at least one assembly component (6); and a suction valve blade (7) provided with at least one operation valve (71) and at least one mounting hole (72); each said at least one operation valve (71) comprising a static end, a dynamic end and a bending area arranged between that static end and that dynamic end;

an interface blade (3) provided with at least one mounting hole (31);

said interface blade (3) being arranged between said discharge valve blade (2) and said stop blade (4);

said interface blade (3) being made of flexible material;

said interface blade (3) comprising a solid part (32) coincident with the static end (211) of each said at least one operation valve (21) of the discharge valve blade (2);

said interface blade (3) comprising a hollow part (33) coincident with the dynamic end (212) and the bending area (213) of each said at least one operation valve (21) of the discharge valve blade (2);

an auxiliary valve blade (8) provided with at least one auxiliary operation valve (81) and at least one mounting hole (82); each said at least one auxiliary operation valve (81) comprising a static end (811), a dynamic end (812) and a bending area (813) arranged between said static end (811) and said dynamic end (812), in which:

said interface blade (3) is arranged between said discharge valve blade (2) and said auxiliary valve blade (8);

the solid part (32) is coincident with the static end of each said at least one auxiliary operation valve (81) of the auxiliary valve blade (8);

the mounting holes of the discharge valve blade (2), the interface blade (3), the stop blade (4) and the auxiliary valve blade (8) are subject to mutual alignment using the at least one assembly component (6); and the solid part (32) of the interface blade (3) connects the static end (211) of each said at least one operation valve (21) of the discharge valve blade (2) with the static end (811) of each said at least one auxiliary operation valve (81) of the auxiliary valve blade (8).

2. The alternative compressor head arrangement according to claim 1, comprising:

an additional interface blade (3') provided with at least one mounting hole (31'); said additional interface blade (3') being arranged between said auxiliary valve blade (8) and said stop blade (4);

said additional interface blade (3') comprising a solid part (32') coincident with the static end of each said at least one auxiliary operation valve (81) of the auxiliary valve blade (8);

said additional interface blade (3') comprising a hollow part (33') coincident with the dynamic end (812) and the bending area (813) of each said at least one auxiliary operation valve (81) of the auxiliary valve blade (8);

the mounting holes of the discharge valve blade (2), the interface blade (3), the additional interface blade (3'), the stop blade (4) and the auxiliary valve blade (8) are subject to mutual alignment using the at least one assembly component (6); and the interface between the static end (811) of each said auxiliary operation valve (81) and the at least one valve stop (41) of the at least one stop blade (4) is provided by the solid part (32') of the additional interface blade (3').

3. The alternative compressor head arrangement according to claim 2, wherein, in each said at least one operation valve (21), the static end (211) and the bending area (213) are arranged such that neither the static end (211) nor the bending area (213) contacts the at least one stop blade (4).

* * * * *